US005898587A

United States Patent [19]

Bell et al.

[11] Patent Number: 5,898,587

[45] Date of Patent: Apr. 27, 1999

[54] SYSTEM FOR SIMULTANEOUS GAME DATA AND ARENA DISPLAY CONTROL

[76] Inventors: Stephen Spencer Bell; Stephen Robert James Bell, both of 1 Brown Street, Marathon, Ontario, Canada, P0T 2E0

[21] Appl. No.: 08/775,602

[22] Filed: Dec. 31, 1996

[51] Int. Cl.[6] ..... G08B 23/00; G06F 15/44

[52] U.S. Cl. ..... 364/411.1; 340/323 R

[58] Field of Search ..... 364/411, 410; 340/323 R, 323 B; 473/70, 71

[56] References Cited

U.S. PATENT DOCUMENTS

| | | | |
|---|---|---|---|
| 3,959,640 | 5/1976 | Syria | 364/411 |
| 4,142,236 | 2/1979 | Martz et al. . | |
| 4,220,992 | 9/1980 | Blood et al. . | |
| 4,890,229 | 12/1989 | Rudnick . | |
| 4,977,503 | 12/1990 | Rudnick et al. . | |
| 4,999,603 | 3/1991 | Mele et al. | 364/411 |
| 5,027,102 | 6/1991 | Sweeny | 364/411 X |
| 5,039,977 | 8/1991 | Mele et al. | 364/411 X |
| 5,083,271 | 1/1992 | Thacher et al. | 364/411 |
| 5,101,354 | 3/1992 | Mowers et al. | 364/411 |
| 5,134,565 | 7/1992 | Herbertz | 364/411 |
| 5,559,490 | 9/1996 | McDonald et al. | 364/411 X |
| 5,574,422 | 11/1996 | Martin | 364/411 X |

FOREIGN PATENT DOCUMENTS 927969 6/1973 Canada .

1 264 495 1/1990 Canada .

*Primary Examiner*—Michael O'Neill

*Attorney, Agent, or Firm*—Sughrue, Mion, Zinn, Macpeak & Seas, PLLC

[57] ABSTRACT

A game data and arena display control apparatus includes a game control keyboard which includes a plurality of keys for generating respective keying signals in accordance with progress of play of a game. A processor is responsive to the keying signals for controlling the starting and stopping of a game clock, and for determining and storing a plurality of game data. The processor is further responsive to the keying signals to generate a first output signal indicative of game data, and a second output signal indicative of user selected data. A monitor is responsive to the processor for displaying information concerning operation of the apparatus during play of the game. A first output port is connected to the processor for outputting the first output signal to an arena scoreboard. Finally, a second output port is connected to the processor for outputting the second output signal to an arena display board. A database of team and player information and statistics is stored in a storage device which can be accessed by the processor during operation of the apparatus. By means of the game data and arena display control apparatus, team results and player statistics can be collected and updated simultaneously with control of a scoreboard and/or display board, by a single operator, during play of a game.

22 Claims, 5 Drawing Sheets

SYSTEM FOR SIMULTANEOUS GAME DATA AND ARENA DISPLAY CONTROL

CROSS-REFERENCE TO RELATED APPLICATIONS

This is the first application filed in respect of the present invention.

BACKGROUND OF THE INVENTION

The present invention pertains to a game data and arena display control apparatus, and in particular to a portable apparatus capable of simultaneously controlling a scoreboard and compiling player and team statistics during a game.

Many games, such as hockey, basketball, football, and baseball are played in prepared arena facilities having a scoreboard for displaying game information (e.g. scores, penalties etc.) for viewing by spectators. Such scoreboards are typically controlled by a specialized controller unit which is designed by the scoreboard manufacturer to operate a particular scoreboard. This arrangement has the advantage that the scoreboard controller can be provided with only the keys which are needed to control the scoreboard, and these keys can be arranged to facilitate ease of use. However, it also requires that a controller unit be purchased at the same time as the scoreboard. If the scoreboard is replaced by an updated model having additional functions, the controller unit must also be replaced in order to use all of the features of the updated scoreboard, thereby increasing costs.

Arenas may also include a display board on which alphanumeric information, such as advertisements, announcements, player and team names, upcoming game schedules and other game information can be displayed. Such display boards are typically controlled by a special purpose display board controller which comprises a small single purpose console and an inexpensive micro-processor circuit. This allows a wide range of different information to be displayed on the display board.

It is often advantageous to use both a score board and a display board during the play of a game. However, the different controller equipment used by the score board and a display board, respectively, makes it difficult for one person to operate both systems.

In community arenas, games are often played by local teams in organized leagues. In order to raise support and enthusiasm among fans within the community, the teams and/or league organizers often compile and publish an assortment of statistics concerning team results, as well as statistics concerning each individual player. Often, the task of compiling and distributing this information is performed manually, which is very time-consuming and can often limit the detail and accuracy of the collected information, as well as the speed with which it can be distributed to fans. Furthermore, the person assigned to recording team and player statistics generally cannot also serve to control the scoreboard or the display board, particularly in a fast-moving game such as hockey or basketball. This means that generally two people must be found, one to operate the scoreboard and arena display equipment and one to collect game data for each game. However, in many community leagues, these tasks are handled on a volunteer basis, with the result that it can be difficult to consistently obtain the necessary number of people for every game. Furthermore, team and player statistics must then be manually complied on the basis of the collected game data, and previously compiled statistics. This is a laborious task, and frequently results in a delay of up to several days between a game and when updated team and player statistics become available to the fans.

BRIEF SUMMARY OF THE INVENTION

An object of the present invention is to provide a game data and arena display control apparatus which simultaneously controls a scoreboard and an arena display board, and which can be conveniently operated by a single user.

Another object of the present invention is to provide a game data and arena display control apparatus which automatically accumulates game and player statistics during the play of a game.

Accordingly, an aspect of the present invention provides a game data and arena display control apparatus comprising a game control keyboard having a plurality of keys for generating respective keying signals in accordance with progress of play of a game. A central processor is responsive to the keying signals for controlling the starting and stopping of a game clock, and for determining and storing a plurality of game data. The central processor is further responsive to the keying signals to generate a first output signal indicative of a game score, and a second output signal indicative of one or more of the game data. A monitor is responsive to the central processor for displaying information concerning operation of the apparatus during play of the game. A first port is provided for outputting the first output signal to an arena scoreboard, and a second port is provided for outputting said second output signal to an arena display board.

Preferably, the plurality of keys includes a plurality of function keys for entering information concerning progress of the game, a plurality of control keys for controlling operation of the apparatus, and a numerical keypad for entering numerical information.

Preferably, the game control keyboard further includes a keying signal generator for generating a keying signal in the form of a predetermined double-key sequence indicative of a key being pressed by a user. The double-key sequence conveniently comprises two ASCII-codes generated in series; a first ASCII-code of the series representing either a standard "Alt" key or a standard "Ctrl" key, and a second ASCII-code of the series being a member of the standard ASCII character set unique to a respective key of the keyboard. By this means, keying signals generated by the keying signal generator can be interpreted by the central processor as either standard "Alt-key" sequences or standard "Ctrl-key" sequences.

In an embodiment of the invention, the game control keyboard includes an input port for operatively coupling a second keyboard to the game control keyboard to form a cascade of keyboards. This arrangement allows keying signals generated by the second keyboard to be transmitted to the central processor via the output port of the game control keyboard. Accordingly, two separate keyboards, for example a game control keyboard and a standard alphanumeric keyboard can be linked together in a cascade so that the keying signals of both keyboards are input to the central processor through a common keyboard jack. This allows an operator to use both keyboards, thereby optimizing usability of the system, while at the same time simplifying programming of the central processor by providing a single keyboard jack through which keyboard signals are received. Preferably, selection means are provided for selectively coupling the input port and the keying signal generator to the output port of the game control keyboard, so that keying signals generated by the keying signal generator, and those of the second keyboard, can be supplied to the output port (and thus the central processor) without interfering with each other.

In an embodiment of the invention, a signal conditioner is operatively coupled between the first port of the central processor and the arena scoreboard, for adjusting the first output signal to conform to the signal requirements of the arena scoreboard.

In one embodiment, the first output signal is a parallel data signal and the arena scoreboard is capable of receiving control signals as a serial data signal. In this case, the signal conditioner includes a parallel input means for receiving the first output signal as a parallel data signal, a multiplexer which converts the parallel first data signal into a serial data stream, and an output circuit which amplifies the serial data stream from the multiplexer to produce an output serial data stream satisfying the voltage and current requirements of the arena scoreboard. This output serial data stream is transmitted to the scoreboard through a suitable cable, such as, for example a standard co-axial cable.

In an alternative embodiment, the first port of the central processor is a parallel input/output port capable of transmitting and receiving parallel data signals, and the arena scoreboard is capable of receiving control signals and sending status signals as serial data signals. In this case, the signal conditioner includes a parallel input means for receiving the first output signal as a parallel data signal, a multiplexer for converting the parallel data signal into a serial data stream, and an I/O circuit for amplifying the serial data stream from the multiplexer to produce an output serial data stream satisfying the voltage and current requirements of said arena scoreboard. This output serial data stream is transmitted to the arena scoreboard through a suitable cable. In addition, the I/O circuit is further arranged to receive serial status signals from the arena scoreboard, through the same cable. These serial status signals are amplified by the I/O circuit to produce an input status data stream satisfying the voltage and current requirements of the central processor. A demultiplexer receives the input status data stream from the I/O circuit and converts the input status data stream into a parallel status signal. Finally, the parallel status signal is supplied to a parallel output means which transmits the parallel status signal to the first port of the central processor.

By means of the present invention, data pertaining to each team (for example team name and player information) can be entered and stored in a data-base prior to the beginning of a season or tournament. In addition, the game schedule for a season or tournament can be entered and stored in memory. Subsequently, as the season or tournament progresses, team results and player statistics can be compiled and stored, based on data collected during the play of each game.

During the play of each game, an operator can enter goals scored, penalties assessed, and other data concerning the play of the game using the game control keyboard. Additional textual data can also be input when the second (i.e. standard alpha-numeric) keyboard is also used. These data are used by the apparatus, under appropriate program control, to update team results and individual player statistics. In addition, the same data is simultaneously used to generate output signals for display of team scores and other relevant information on an arena scoreboard and/or an arena display board. Thus by means of the present invention, the team results and player statistics can be collected and updated simultaneously with control of a scoreboard and/or display board, by the same person, during play of each game.

The present invention allows a large number of statistical reports to be compiled and made available to fans immediately after a game is completed. At the completion of each game, for example, the game data and arena display apparatus of the present invention can provide a neatly compiled game sheet, a statistical game summary of all point getters, updated league standings, as well as numerous other reports, as desired by users of the apparatus. Furthermore, both game data recording and arena display control can be conveniently be performed by one person. The apparatus of the invention can be programmed to allow the automatic generation of a variety of pre-formatted media reports that can be immediately provided to newspapers, radio and T.V. In addition, the apparatus can automatically compile a variety of statistical report which can be of great assistance to team or league statisticians and promotion managers. It can also have the capacity to feed similar reports and other statistical information directly onto a channel on a community cable-T.V. system.

Thus the present invention offers two principal sets of capabilities: automatic control an arena scoreboard and/or arena display board during play of a game; and automatic generation of a game sheet and statistical summaries immediately following each game. Those skilled in the art will recognise that the opportunity exists to use one capability without necessarily employing the other. Thus some users may choose to employ only the game sheet generation capacity. The scoreboard and arena display board control capabilities could be used at a later date, if desired. However in both cases the game control keyboard is used as the central element of the apparatus.

BRIEF DESCRIPTION OF THE DRAWINGS

Further features and advantages of the present invention will be described, by way of an example, with reference to the appended drawings in which.

DETAIL DESCRIPTION OF THE INVENTION

In the following description, the present invention is described by way of an example embodiment designed for use in hockey. It will be readily apparent, however, that this use is in no way limitative of the present invention. In fact, the present invention can be readily adapted for use in basket-ball, baseball, or indeed virtually any team sport.

Figure 1:
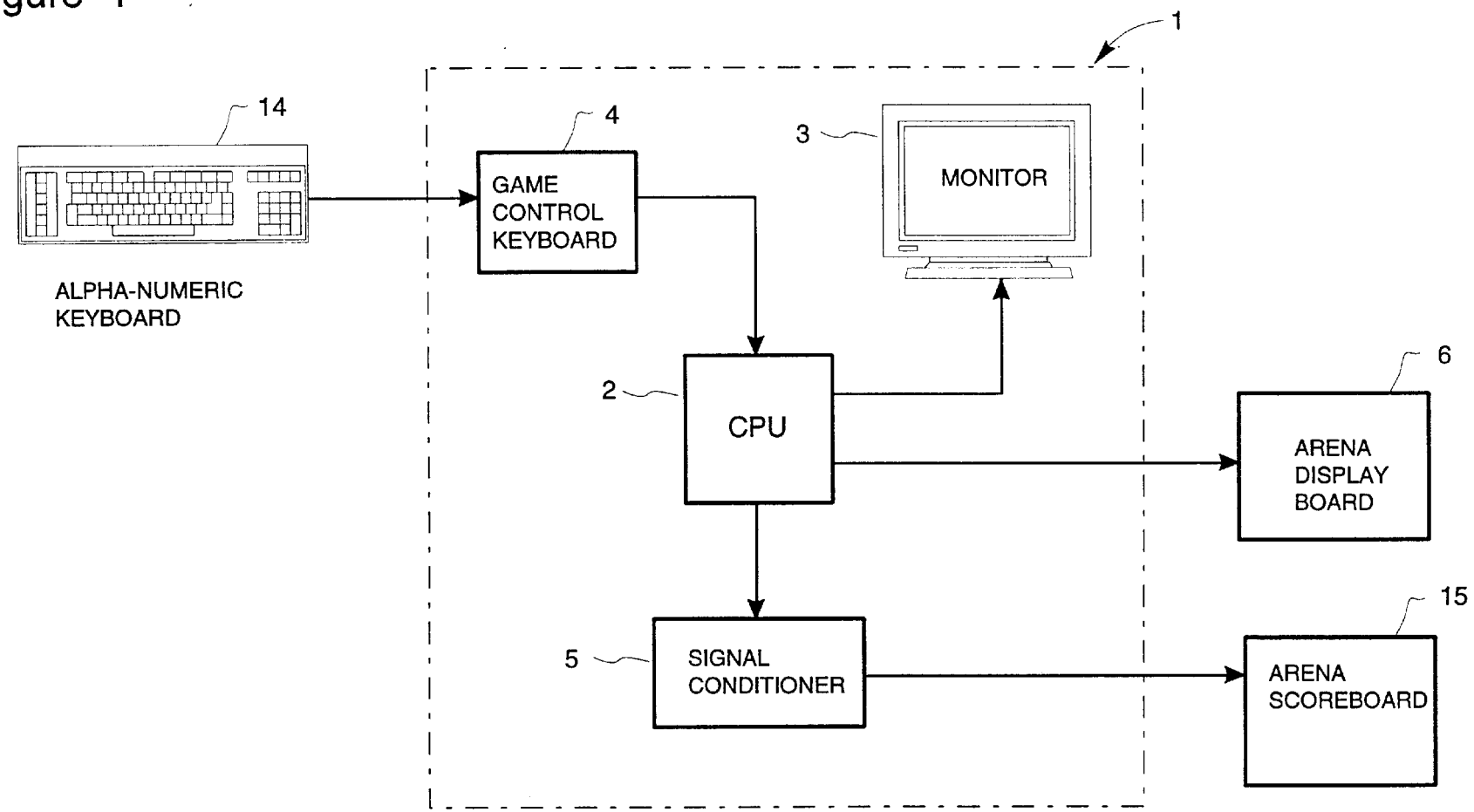
FIG. 1 shows an schematic illustration of a game control apparatus according to an embodiment of the present invention.

Referring to FIG. 1, a game control apparatus 1 in accordance with the present invention generally comprises a central processor unit (CPU) 2, a monitor 3, a game control keyboard 4 and a signal conditioner 5. The CPU 2, monitor 3, game control keyboard 4 and signal conditioner 5 can be provided as separate units operatively coupled together using appropriate cables, or may be provided as a single integrated system, as is schematically shown by the dashed line of FIG. 1. Alternatively, the CPU 2 and monitor 3 can be provided as an integrated unit, with the game control keyboard 4 and signal conditioner 5 coupled thereto using suitable cables.

The CPU 2 receives keying signals from the game control keyboard 4, and, in accordance with a control program, displays game information, system status information or the like on the monitor 3. The CPU 2 can conveniently be provided as a conventional computer, such as, for example any of the popular IBM-PC compatible personal computers or Macintosh (tradename) computers. The CPU 2 can conveniently include storage means (not shown), such as, for example, conventional magnetic storage media, for storing control programs for controlling the operation of the game control apparatus 1, as well as a database of team/player and game statistics which can be retrieved, displayed, modified, and re-stored in the storage means during operation of the game control apparatus 1. The monitor 3 can be provided as a conventional computer monitor, such as, for example a CRT or LCD screen connected to a video port of the CPU 2.

The CPU 2 is connected to a conventional arena display board 6, such as, for example an LED message display system manufactured by Display Ad Inc. via a suitable cable connected to a serial output port of the CPU 2, such as, for example an RS-232 port identified by the CPU 2 as COM2. This allows the arena display board 6 to be connected to a conventional computer system, via a serial output port, and controlled using control codes and commands issued by the CPU 2 under appropriate program control.

Figure 2:
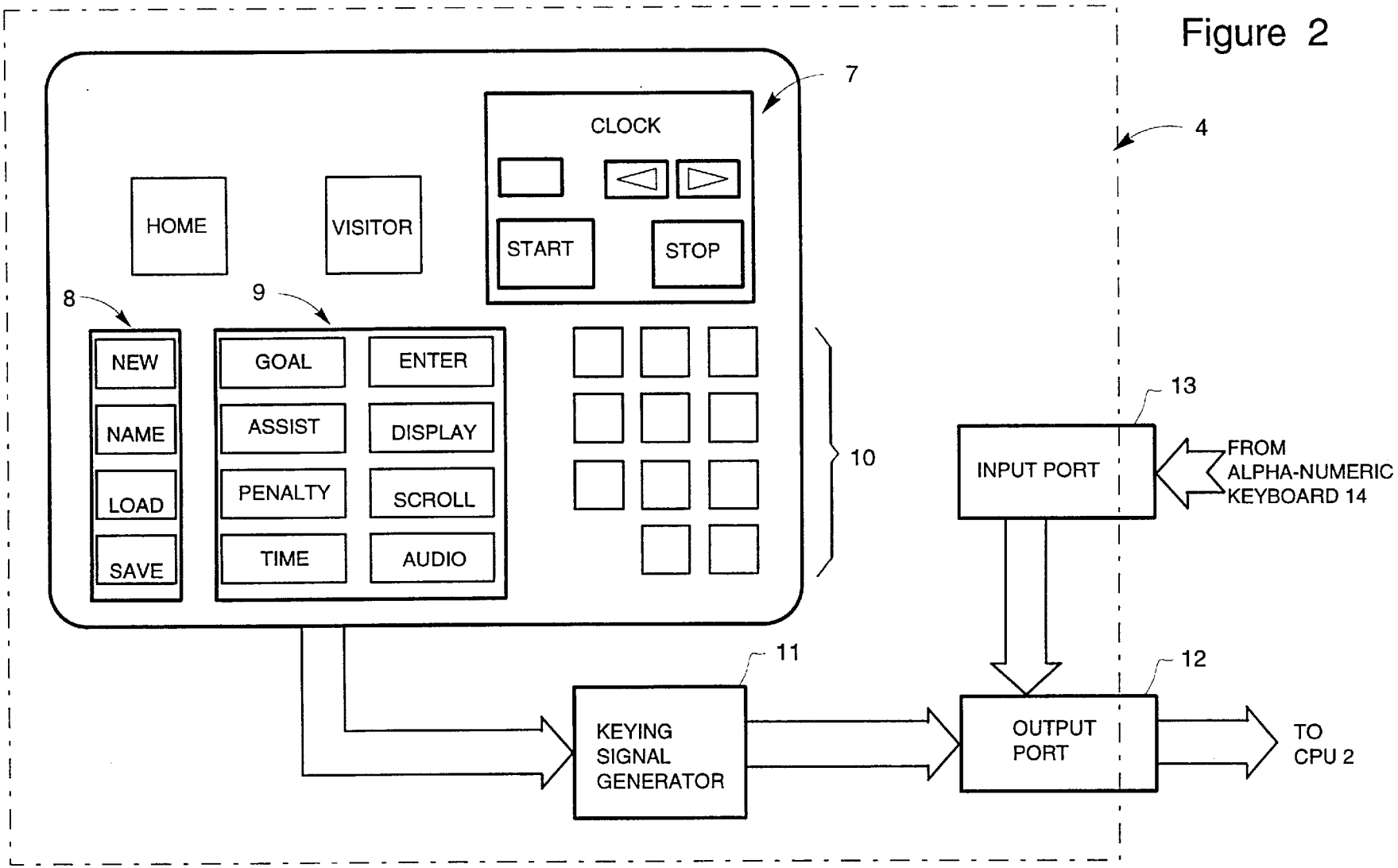
FIG. 2 shows a schematic illustration of a game control keyboard according to an embodiment of the present invention.

Referring now to FIGS. 1 and 2 together, a game control keyboard 4 is connected to the CPU 2 to allow a user to conveniently enter game data and effect system control. Preferably, the game control keyboard 4 is provided with control and data-entry keys clustered into conveniently usable clusters. For example, clock control keys 7, program control keys 8, game and scoreboard control keys 9 and a numerical keypad 10, are all arranged in separate clusters, so that a user can quickly enter game control data during the play of a game, with minimum possibility of error. As the various keys of the game control keyboard 4 are pressed, a keying signal generator 11 generates a unique keying signal indicative of each key which is pressed. The keying signal generator 11 can be provided as a switch circuit which may conveniently incorporate the keys of the game control keyboard 4 in a manner similar to that employed in conventional alphanumeric keyboards. Alternatively, the keying signal generator 11 can be provided as a microprocessor responsive to the keys of the game control keyboard 4. The keying signal is supplied to the CPU 2 through an output port 12 which may be, for example, a conventional keyboard port commonly used in conventional computer systems.

In accordance with the present invention, the keying signals generated by the keying signal generator 11 are preferably in the form of an ASCII double-key sequence, such as, for example an "Alt-key" or "CTRL-key" sequence made up of standard ASCII codes. This allows the CPU 2, under program control, to receive and interpret the keying signals, and thereby facilitate the entry of game data, and/or control of the system and the arena scoreboard as desired by the user.

Often, the information to be displayed on an arena display board 6 is of a nature that a general purpose alphanumeric keyboard is required to effect the desired data entry and control operations. Accordingly, the game control keyboard 4 also conveniently includes an input port 13 so that such a general-purpose alphanumeric keyboard 14 can be connected to the game control keyboard 4.

As shown in FIG. 2, the input port 13 is connected to the output port 12, bypassing the keying signal generator 11, so that keying signals generated by the general-purpose alphanumeric keyboard 14 are passed directly to the output port 12 and then to the CPU 2. It is important, however, that keying signals received through the input port 13 are prevented from colliding (and interfering) with keying signals of the game control keyboard 4 itself. Accordingly, it will be preferable to provide the output port 12 with selection means (not shown), such as, for example, a switching circuit, for selectively connecting either the keying signal generator 11 or the input port 13 to the output port 12 (and thus the CPU 2).

In one embodiment, the selection means can be designed to normally maintain the input port 13 connected to the output port 12, while the keying signal generator 11 is maintained disconnected from the output port 12. Thus keying signals from the general-purpose alphanumeric keyboard 14 can pass directly through to the CPU 2, and are protected from interference due to signals from the keying signal generator 11. In this case, the selection means is responsive to the keying signal generator 11 (for example upon receipt of a "key pressed" signal from the keying signal generator 11) to disconnect the input port 13 from the output port 12 and simultaneously connect the keying signal generator 11 to the output port 12. This operation allows keying signals from the keying signal generator 11 to be transmitted to the CPU 2 when any of the keys of the game control keyboard 4 is pressed, without interference due to signals from the general-purpose alphanumeric keyboard 14.

Conversely, the selection means can be designed to normally maintain the keying signal generator 11 connected to the output port 12, while the input port 13 is maintained disconnected from the output port 12. Thus keying signals from the keying signal generator 11 can pass directly through to the CPU 2, and are protected from interference due to signals from the general-purpose alphanumeric keyboard 14. In this case, the selection means is responsive to the general-purpose alphanumeric keyboard 14 (for example upon receipt of a "key pressed" signal from the general-purpose alphanumeric keyboard 14) to disconnect the keying signal generator 11 from the output port 12 and simultaneously connect the input port 13 to the output port 12. This operation allows keying signals from the general-purpose alphanumeric keyboard 14 to be transmitted to the CPU 2 when any of the keys of the general-purpose alphanumeric keyboard 14 is pressed, without interference due to signals from the keying signal generator 11 of the game control keyboard 4.

Figure 2A:
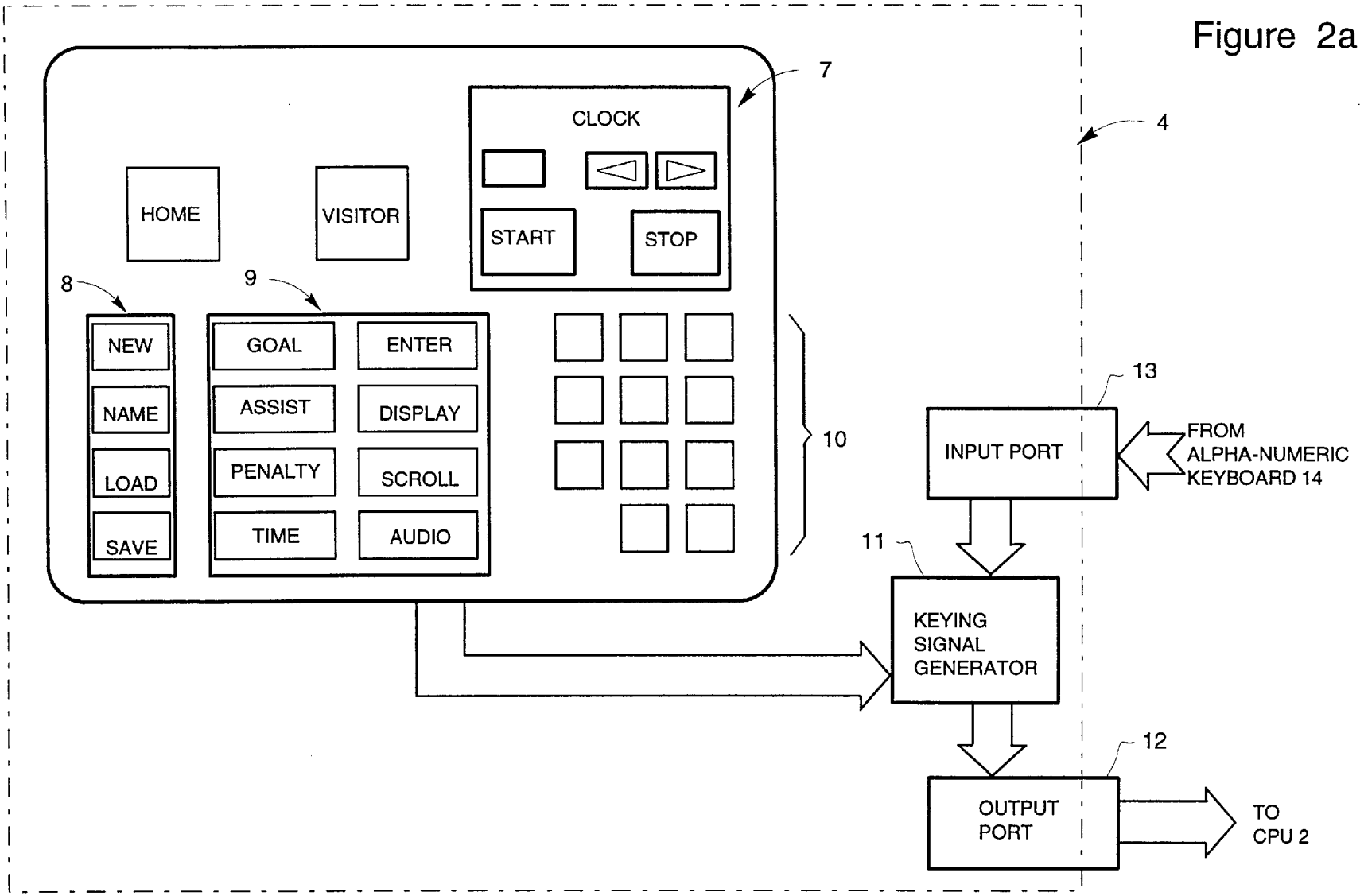
FIG. 2*a* shows a schematic illustration of an alternative game control keyboard according to an embodiment of the present invention.

As a still further alternative, the input port 13 can be connected so as to supply keying signals from the general-purpose alphanumeric keyboard 14 to the keying signal generator 11, as shown in FIG. 2*a*. In this case, the keying signal generator 11 would be designed to pass the keying signals from the general-purpose alphanumeric keyboard 14 through to the output port 12, while temporarily blocking signals from the keys of the game control keyboard 4 itself. In effect, the keying signal generator 11 in this embodiment is designed to incorporate the functions of the selection means described above.

With all of the above-described alternative embodiments, signals received from the general-purpose alphanumeric keyboard 14, which are most commonly simple ASCII key-codes, are passed through the game control keyboard 4 to the CPU 2 unchanged.

As illustrated in FIG. 1, this arrangement produces a cascade of keyboards by which the CPU 2 can be controlled. The use of the double-key sequence of the game control keyboard 4 allows the CPU 2 to readily distinguish system control and game data, which generally affect the operations of the program running the CPU 2, from alpha-numeric data which is generally stored in a database and/or sent to the arena display board 6.

In that respect, it will be noted that general-purpose alphanumeric keyboards typically include an "Alt" key and a "CTRL" key, and are capable of generating corresponding double-key sequences when these keys are pressed in combination with another key. On this basis, it would be entirely possible for a user to control all of the operations of the CPU 2 using only a general-purpose alphanumeric keyboard 14 connected to the CPU 2 (either with or without an intervening game control keyboard 4). In principle, this would be a workable arrangement. However, it would require the user to memorize a large number of "Alt-key" and/or "CTRL-key" codes to effect system control and game data entry, and thus would be significantly slower and more difficult to use for this purpose than the game control keyboard 4. Accordingly, it will be preferable to use the game control keyboard 4 for system control and game data entry, and a general-purpose alphanumeric keyboard 14 connected in cascade with the game control keyboard 4 for entry of alphanumeric information and for control of an arena display board 6.

Figure 3:
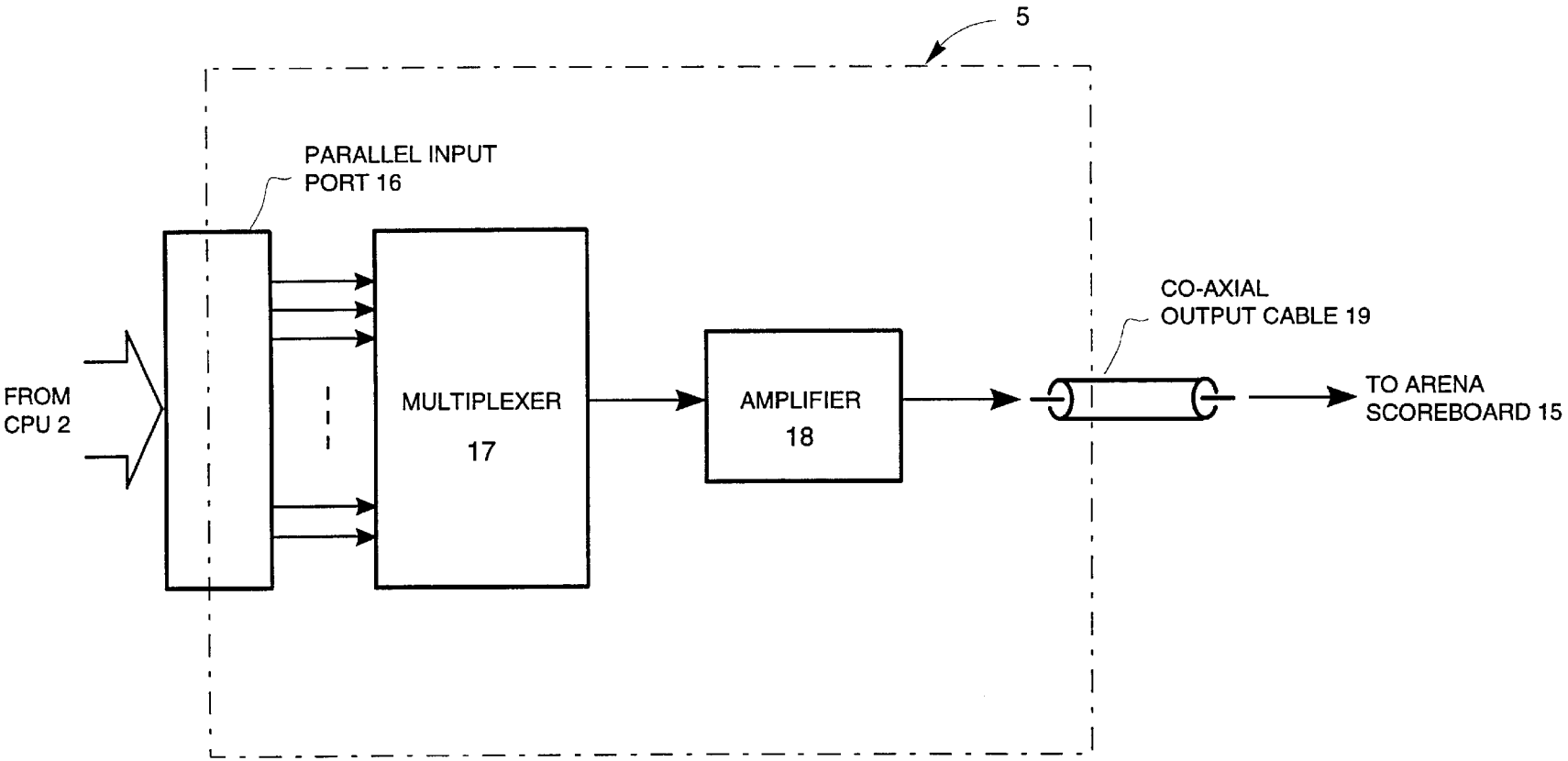
FIG. 3 shows a schematic illustration of a signal conditioner according to an embodiment of the present invention.

Referring now to FIGS. 1 and 3 together, the CPU 2 is also connected to the arena scoreboard 15 via a signal conditioner 5 and a suitable cable connected to a parallel output port of the CPU 2, such as, for example, the parallel printer port identified by the CPU 2 as LPT1.

Conventional arena scoreboards, such as, for example, an illuminated arena scoreboard manufactured by Nevco Scoreboard Co., are typically driven by a special-purpose controller unit (not shown) connected to the scoreboard through a cable. A typical arena scoreboard controller of this type is capable of controlling 32 different functions, by generating respective command signals. In operation, the controller unit generates appropriate command signals in response to a user pushing buttons of the controller. These command signals are transmitted to the arena scoreboard through a serial cable (such as, for example, a conventional 50 Ohm co-axial cable) as a serial data stream. A decoder unit in the arena scoreboard decodes the serial data stream and controls the scoreboard accordingly.

In a conventional 32-pin parallel output port of a computer, such as LPT1 mentioned above, 8 printer data pins, (typically pins 2–9) are available for parallel data output. An additional 4 pins (e.g. pins 1, 14, 16, and 17) are available for control operations (such as, for example, error detection, handshaking, etc). A further 5 pins (e.g. pins 10, 11, 12, 13, and 15) are used for data input.

The 8 printer data pins are typically connected to data registers (e.g. D0, D1 . . . D7) of the CPU 2, enabling the CPU 2 to output up to $2^8$=256 different data (i.e. scoreboard control) signal combinations, which is significantly more than is typically required to control the arena scoreboard 15. It is therefore possible to program the processor of the CPU 2 to supply signals to a parallel output port of the CPU 2 which emulate those generated by the special-purpose controller. However, these signals generated by the CPU 2 will, in general, not satisfy the voltage/current requirements of the scoreboard and/or may not be impedance matched with the cable connected to the scoreboard 15. Furthermore, the parallel data signal generated by the CPU 2 must be converted into a serial data stream for transmission to the scoreboard 15.

Accordingly, the present invention provides a signal conditioner unit 5 which is connected in series between the CPU 2 and the arena scoreboard 15. The signal conditioner 5 includes a parallel input port 16 for connection to a matching parallel output port of the CPU 2. Parallel scoreboard control signals are received from the CPU 2 through the parallel input port 16, and supplied to a multiplexer 17. The multiplexer 17 converts the parallel signal from the CPU 2 into a serial data signal which is supplied to an amplifier circuit 18. The amplifier circuit 18 adjusts the voltage and current characteristics of the data signal to suit the specific requirements of the scoreboard 15. The output of the amplifier circuit 18 is connected to a serial data cable 19 connected to the arena scoreboard 15, so that the serial data stream output from the amplifier circuit 18 is transmitted to the scoreboard 15. The output of the amplifier circuit 18 is impedance matched to the cable 19, so that the serial data stream can be efficiently transmitted through the cable 19, which may be up to 30 meters or more in length. By this means, the CPU 2 can be programmed to emulate the control signal output of the conventional special-purpose controller, thereby allowing the CPU 2 to control the arena scoreboard 15.

Figure 4:
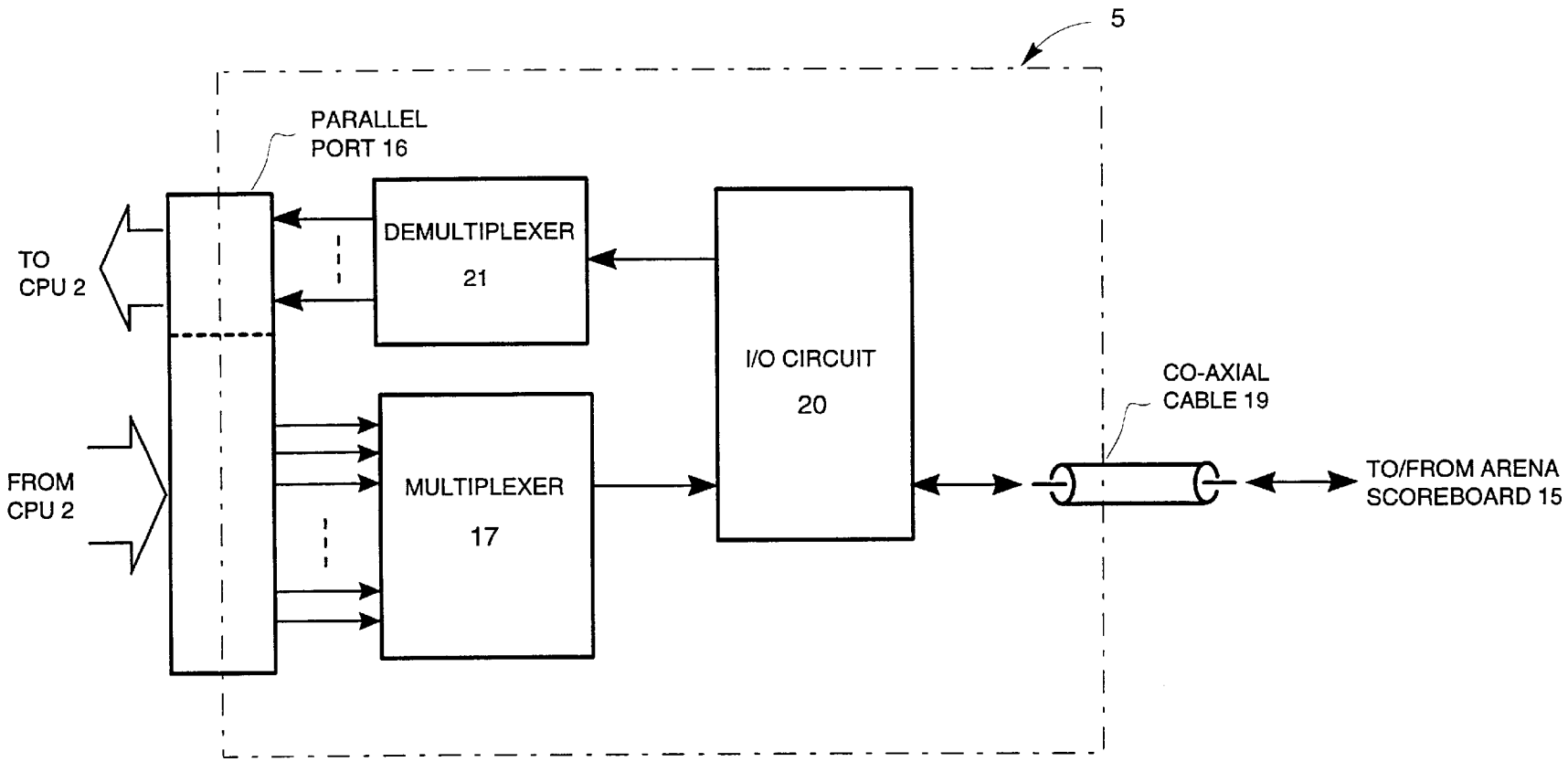
FIG. 4 shows a schematic illustration of a signal conditioner according to another embodiment of the present invention.

FIG. 4, illustrates an embodiment of the signal conditioner 5 in which data signals, for example indicating the status of the arena scoreboard 15 can be read by the CPU 2. In this case, the amplifier circuit 18 is replaced by an I/O circuit 20. The I/O circuit 20 includes a signal amplifier for adjusting the adjusting the current/voltage of data signals, and for impedance matching in substantially the same manner as described above for the amplifier 18. Additionally, the I/O circuit receives scoreboard data signals generated by the scoreboard, and which may indicate, for example, the status of the scoreboard. The I/O circuit adjusts the current/voltage characteristics of the serial scoreboard data signals to suit the input requirements of the CPU 2. The adjusted scoreboard data signals are then supplied to a demultiplexer 21, which converts the serial scoreboard data signal into a parallel signal which is supplied to the data input pins (e.g. pins 10, 11, 12, 13, and 15) of the parallel port 16. By this means, the scoreboard data signals can be supplied to the CPU 2, and, for example, displayed on the monitor 3.

It will be noted that scoreboard manufacturers typically offer several different models of scoreboard, each requiring respective (and often quite different) sets of control signals, depending on the amount of information displayed by the scoreboard model in question. These differing control signal requirements normally necessitate the use of a different controller for different scoreboard models. However, this problem is eliminated by the present invention, as different control signal requirements (i.e. more or fewer parallel signals) can be simply accommodated by suitably adjusting the programming of the CPU 2 to supply more of fewer control signals to respective conductors of the CPU's parallel port. Differing voltage/current requirements of the various scoreboard models can be accommodated by adjustment of the gain of the amplifier circuit 18 (or I/O circuit 20) in the signal conditioner unit 5.

This arrangement allows an apparatus in accordance with the present invention to be used with a wide variety of different arena scoreboard models. For example, the CPU 2 can be provided with a predetermined database which includes an identifier field for identifying a particular scoreboard model, and one or more control fields which specify the respective parallel port pin assignments and control signal requirements of the particular scoreboard model. In use, the CPU 2 is connected to the arena scoreboard 15, via the signal conditioner 5. The user then selects from the database the model of the scoreboard being used, and the CPU 2 sets the parallel port pin assignments and signal requirements necessary to control the scoreboard 15, on the basis of the control information provided in the database. If necessary, the user can then adjust the gain of the amplifier 18 (or I/O circuit 20) in the signal conditioner 5 to suit the voltage/current requirements of the scoreboard 15. Alternatively, a number of conductors of the CPU parallel port and the signal conditioner parallel input port 16 can be suitably connected to allow the CPU 2 to control the gain of the amplifier circuit 18 in the signal conditioner 5. By this means, the gain of the amplifier circuit 18 (or I/O circuit 20) can be adjusted by the CPU 2 at the same time and on the same basis as the setting of the parallel port pin assignments and signal requirements, thereby eliminating the need for any manual adjustment by the user.

It will be recognised that various alternative embodiments of the present invention can be designed without departing from the scope of the appended claims. For example, in the above description, the game control keyboard 4 is described as including an input port to which a second keyboard, for example a general-purpose alphanumeric keyboard 14 can be attached to form a cascade. However, it will be appreciated that the order of these keyboards could be reversed. In this case, a conventional alpha-numeric keyboard would be modified to include an input port connected to its output port so that a second keyboard (i.e. a game control keyboard 4) can be connected in cascade with the alpha-numeric keyboard. The alpha-numeric keyboard can also be further modified to remove the Alt and/or CTRL keys, if desired, so that all system control and game data entry functions are performed exclusively by the game control keyboard 4.

We claim:

1. A game data and arena display control apparatus comprising:

a game control keyboard comprising a plurality of keys for generating respective keying signals in accordance with progress of play of a game;

a central processor responsive to the keying signals for controlling the starting and stopping of a game clock, and for determining and storing a plurality of game data, the central processor being further responsive to the keying signals to generate a first output signal indicative of a game score, and a second output signal indicative of one or more of the game data;

a monitor responsive to the central processor for displaying information concerning operation of the apparatus during play of the game;

a first port for outputting said first output signal to an arena scoreboard; and a second port for outputting said second output signal to an arena display board;

wherein the game control keyboard further comprises a keying signal generator for generating a keying signal in the form of a predetermined double-key sequence indicative of a key being pressed by a user, and an output port for outputting the keying signal to the central processor.

2. A game data and arena display control apparatus as claimed in claim 1, wherein the plurality of keys includes a plurality of function keys for entering information concerning progress of the game, a plurality of control keys for controlling operation of the apparatus, and a numerical keypad for entering numerical information.

3. A game data and arena display control apparatus as claimed in claim 1, wherein the double-key sequence comprises two ASCII-codes generated in series, a first ASCII-code of the series representing either a standard "Alt" key or a standard "Ctrl" key, and a second ASCII-code of the series being a member of the standard ASCII character set unique to a respective key of the keyboard, whereby keying signals generated by the keying signal generator can be interpreted by the central processor as either standard "Alt-key" sequences or standard "Ctrl-key" sequences.

4. A game data and arena display control apparatus as claimed in claim 1, wherein the game control keyboard further comprises an input port for operatively coupling a second keyboard to the game control keyboard to form a cascade of keyboards, such that keying signals generated by the second keyboard are transmitted to the central processor via the output port of the game control keyboard.

5. A game data and arena display control apparatus as claimed in claim 4, wherein the game control keyboard further comprises selection means for selectively coupling the input port and the keying signal generator to the output port, whereby keying signals generated by the keying signal generator and those of the second keyboard are supplied to the output port without interfering with each other.

6. A game data and arena display control apparatus as claimed in claim 5, wherein the selection means comprises a selection circuit operatively coupled to the input port, the keying signal generator and the output port, the selection circuit normally maintaining the input port connected to the output port and the keying signal generator disconnected from the output port so that keying signals from said second keyboard can pass directly through to the central processor, the selection circuit being responsive to the keying signal generator to disconnect the input port from the output port and simultaneously connect the keying signal generator to the output port so that keying signals from the keying signal generator can be transmitted to the central processor when any of the plurality of keys of the game control keyboard is pressed.

7. A game data and arena display control apparatus as claimed in claim 5, wherein the selection means comprises a selection circuit operatively coupled to the input port, the keying signal generator and the output port, the selection circuit normally maintaining the keying signal generator connected to the output port and the input port disconnected from the output port so that keying signals from said keying signal generator can pass directly through to the central processor, the selection circuit being responsive to the input port to disconnect the keying signal generator from the output port and simultaneously connect the input port to the output port so that keying signals from the second keyboard can be transmitted to the central processor when a key of the second keyboard is pressed.

8. A game data and arena display control apparatus as claimed in claim 5, wherein the keying signal generator includes the selection means, the keying signal generator being operatively connected to receive signals from the plurality of keys of the game control keyboard and the input port, and being operative to selectively transmit respective keying signals of the game control keyboard and the second keyboard to the central processor unit.

9. A game data and arena display control apparatus as claimed in claim 4, wherein the second keyboard is a conventional alphanumeric keyboard for inputting alphanumeric data to the central processor.

10. A game data and arena display control apparatus as claimed in claim 1, further comprising a signal conditioner operatively coupled between the first port of the central processor and the arena scoreboard, for adjusting said first output signal to conform to the input signal requirements of the arena scoreboard.

11. A game data and arena display control apparatus as claimed in claim 10, wherein said first output signal is a parallel data signal and said arena scoreboard is capable of receiving control signals as a serial data signal, said signal conditioner comprising:

parallel input means for receiving said first output signal as a parallel data signal;

a multiplexer for converting said parallel first data signal into a serial data stream; and an amplifier for amplifying said serial data stream from said multiplexer to produce an output serial data stream satisfying the voltage and current requirements of said arena scoreboard, and for outputting said output serial data stream to said arena scoreboard.

12. A game data and arena display control apparatus as claimed in claim 10, wherein said first port of said central processor is a parallel input/output port capable of transmitting and receiving parallel data signals and said arena scoreboard is capable of receiving control signals and sending status signals as serial data signals, said signal conditioner comprising:

parallel input means for receiving said first output signal as a parallel data signal;

a multiplexer for converting said parallel first data signal into a serial data stream; and an I/O circuit for amplifying said serial data stream from said multiplexer to produce an output serial data stream satisfying the voltage and current requirements of said arena scoreboard and for outputting said output serial data stream to said arena scoreboard, said I/O circuit being further operative to receive serial status signals from said arena scoreboard and amplifying said serial status signals to produce an input status data stream satisfying the voltage and current requirements of said central processor a demultiplexer for receiving said input status data stream from said I/O circuit and for converting said input status data stream into a parallel status signal; and parallel output means for transmitting said parallel status signal to said first port of said central processor.

13. In a game data and arena display control apparatus, a game control keyboard comprising:

a plurality of keys;

a keying signal generator for generating a keying signal in the form of a predetermined double-key sequence indicative of a key being pressed by a user; and output means for outputting the keying signal.

14. A game control keyboard as claimed in claim 13, wherein the plurality of keys includes a plurality of function keys for entering information concerning progress of the game, a plurality of control keys for controlling operation of the apparatus, and a numerical keypad for entering numerical information.

15. A game control keyboard as claimed in claim 13, further comprising a keying signal generator for generating a keying signal in the form of a predetermined double-key sequence indicative of a key being pressed by a user, and an output port for outputting the keying signal to a central processor of the game data and arena display control apparatus.

16. A game control keyboard as claimed in claim 15, wherein the double-key sequence comprises two ASCII-codes generated in series, a first ASCII-code of the series representing either a standard "Alt" key or a standard "Ctrl" key, and a second ASCII-code of the series being a member of the standard ASCII character set unique to a respective key of the keyboard, whereby keying signals generated by the keying signal generator can be interpreted by the central processor as either standard "Alt-key" sequences or standard "Ctrl-key" sequences.

17. A game control keyboard as claimed in claim 16, further comprising an input port for operatively coupling a second keyboard to the game control keyboard to form a cascade of keyboards, such that keying signals generated by the second keyboard are transmitted to the central processor via the output port of the game control keyboard.

18. A game control keyboard as claimed in claim 17, further comprising selection means for selectively coupling the input port and the keying signal generator to the output port, whereby keying signals generated by the keying signal generator and those of the second keyboard are supplied to the output port without interfering with each other.

19. A game control keyboard as claimed in claim 18, wherein the selection means comprises a selection circuit operatively coupled to the input port, the keying signal generator and the output port, the selection circuit normally maintaining the input port connected to the output port and the keying signal generator disconnected from the output port so that keying signals from said second keyboard can pass directly through to the central processor, the selection circuit being responsive to the keying signal generator to disconnect the input port from the output port and simultaneously connect the keying signal generator to the output port so that keying signals from keying signal generator can be transmitted to the central processor when any one or more of the plurality of keys of the game control keyboard is pressed.

20. A game control keyboard as claimed in claim 18, wherein the selection means comprises a selection circuit operatively coupled to the input port, the keying signal generator and the output port, the selection circuit normally maintaining the keying signal generator connected to the output port and the input port disconnected from the output port so that keying signals from said keying signal generator can pass directly through to the central processor, the selection circuit being responsive to the input port to disconnect the keying signal generator from the output port and simultaneously connect the input port to the output port so that keying signals from the second keyboard can be transmitted to the central processor when a key of the second keyboard is pressed.

21. A game control keyboard as claimed in claim 18, wherein the keying signal generator includes the selection means, the keying signal generator being operatively connected to receive signals from both the plurality of keys of the game control keyboard and the second keyboard, and being operative to selectively transmit respective keying signals of the game control keyboard and the second keyboard to the central processor unit.

22. A game control keyboard as claimed in claim 17, wherein the second keyboard is a conventional alphanumeric keyboard for inputting alpha-numeric data to the central processor.

* * * * *